United States Patent [19]

Whiteman

[11] Patent Number: 4,619,111

[45] Date of Patent: Oct. 28, 1986

[54] OILFIELD CLOSING DEVICE OPERATING SYSTEM

[75] Inventor: Jack Whiteman, Houston, Tex.

[73] Assignee: Hydril Company, Los Angeles, Calif.

[21] Appl. No.: 648,533

[22] Filed: Sep. 7, 1984

[51] Int. Cl.[4] ..... F01B 29/08

[52] U.S. Cl. ..... 60/632; 91/4 R

[58] Field of Search ..... 60/632; 91/4 R

[56] References Cited

U.S. PATENT DOCUMENTS 2,986,005 5/1961 Dudley ..... 60/632

3,100,965 8/1963 Blackburn ..... 91/4 R 4,074,527 2/1978 Sadler ..... 91/4 R

*Primary Examiner*—A. Michael Chambers

*Attorney, Agent, or Firm*—Dodge, Bush & Moseley

[57] ABSTRACT

A system including a solid propellant gas generator for generating closing pressure for an oilfield closing device is disclosed. The system provides a reliable source of hydraulic power for emergency operation of blowout preventers, diverters and the like. A solid propellant gas generator is actuated by an actuating signal. Resultant high pressure gases are applied either directly to the oilfield closing device, or to a hydraulic reservoir operably forcing hydraulic fluid to the closing device.

19 Claims, 5 Drawing Figures

OILFIELD CLOSING DEVICE OPERATING SYSTEM

BACKGROUND OF THE INVENTION

1. Field of the Invention

This invention relates in general to the field of control devices for the operation of oilfield closing devices such as blowout preventers, diverters, valves and the like. In particular, the invention relates to control systems for the emergency operation of blowout preventers.

2. Description of the Prior Art

Prior art control systems for the operation of blowout preventers such as annular blowout preventers, ram blowout preventers, diverters and the like, have included a source of hydraulic power and a control valve system for directing closing or operating hydraulic pressure to the closing device for an oil and gas well. In general, the source of hydraulic power includes accummulator bottles and hydraulic pumps.

Accumulator bottles are containers which store hydraulic fluid under pressure for use in effecting blowout preventer closure. Through the use of compressed nitrogen gas, these containers store energy which can be used to effect rapid blowout preventer closure. The prior art systems have required that all blowout preventer closing units should be equipped with accummulator bottles with sufficient volumetric capacity to provide the usable hydraulic fluid volume (with the pumps inoperative) to close one pipe ram and an annular preventer in a blowout preventer stack plus the volume to open a hydraulic choke line valve. In general, the accummulators are called upon to be able to close each ram preventer within thirty seconds. Closing time is generally required to not exceed thirty seconds for annular preventers which are smaller than twenty inches and forty-five seconds for annular preventers which are twenty inches in diameter and greater. Thus, the accummulators are called upon to close the annular and ram blowout preventers in an emergency situation, such as a well kick.

In general, the control system for a blowout preventer stack also requires a pump system. A general requirement is that if the accummulator system were to be removed from service, the pumps should be capable of closing the annular preventer on the size drill pipe being used plus opening the hydraulically operated choke line valve and obtain a minimum of two hundred psi pressure above accummulator precharge pressure on the closing unit manifold within two minutes or less.

In general, the power for closing unit pumps should be available to the accummulator unit at all times such that the pumps will automatically start when the closing unit manifold pressure has decreased to less than ninety percent of the accummulator operating pressure. Two or three independent sources of power are generally required on each closing unit. The dual source power system usually recommended is an air system plus an electrical system.

The source of hydraulic power passes through regulators and control valves before being applied to the individual annular or ram blowout preventers.

The prior art control systems as described above, although reliably are not infallible. Pumps will not operate when their usual power sources are interrupted. It is conceivable that the electric pump and an air pump may simultaneously fail. Accummulators do not function properly at times due to loss of gas precharge, due to closed block valves or due to operator failure to operate a proper manifold valve. In addition, regulators and fluid control valves of the control panel may at times be inoperative or fail.

Identification of Objects of the Invention

It is therefore an object of this invention to provide an emergency system for the operation of oilfield closing devices to overcome the possible reliability problems of the prior art.

It is another object of the invention to provide an emergency system to generate control fluid for oilfield closing devices which requires no auxiliary power sources, which is easy to maintain, and which is relatively inexpensive to operate.

It is another object of the invention to provide an extremely simple emergency system for generating pressurized control fluid to operate oilfield devices which is inherently more reliable than prior art systems.

SUMMARY OF THE INVENTION

The above identified objects of the invention as well as other advantages and features which result therefrom are provided in a system for generating pressurized hydraulic fluid to operate an oilfield closing device including a solid propellant gas generator for generating high pressure gas when actuated. According to one embodiment of the invention, a pressure vessel filled with hydraulic fluid is connected by means of a conduit to the output of the gas generator. Another conduit is connected between the pressure vessel and the closing port of the hydraulically driven piston of an oilfield closing device such as a ram blowout preventer, an annular blowout preventer or a diverter. An actuator is provided for activating the gas generator.

According to the invention, a check valve is provided in the conduit between the high pressure fluid tank and the closing chamber of the oilfield closing device. A relief valve is connected to the conduit between the solid propellant gas generator and the pressure vessel.

The solid propellant gas generator includes a structural breech and a solid propellant gas generator cartridge removably disposed in the structural breech. One embodiment of the actuator includes a pressurized fluid source means, an actuating conduit disposed between the fluid source and the detonator and a valve disposed in the actuating conduit to allow emergency communication of the fluid source and the detonator for operably actuating the gas generator cartridge. The fluid may either be hydraulic liquid or gas. Additionally, the detonator may be actuated by an electrical current source. The actuator may also be a manual plunger for forcefully impacting the detonator so as to actuate the gas generator cartridge.

According to an alternative embodiment of the invention, a system for operating an oilfield closing device includes a solid propellant gas generator for generating high pressure gas when actuated and a conduit connected between the output of the gas generator and the closing port of the gas driven piston of the oilfield closing device and an actuating means for activating the gas generator means, operably causing the high pressure gas to be conducted via the conduit to the closing port.

DESCRIPTION OF THE INVENTION

Figure 1A:
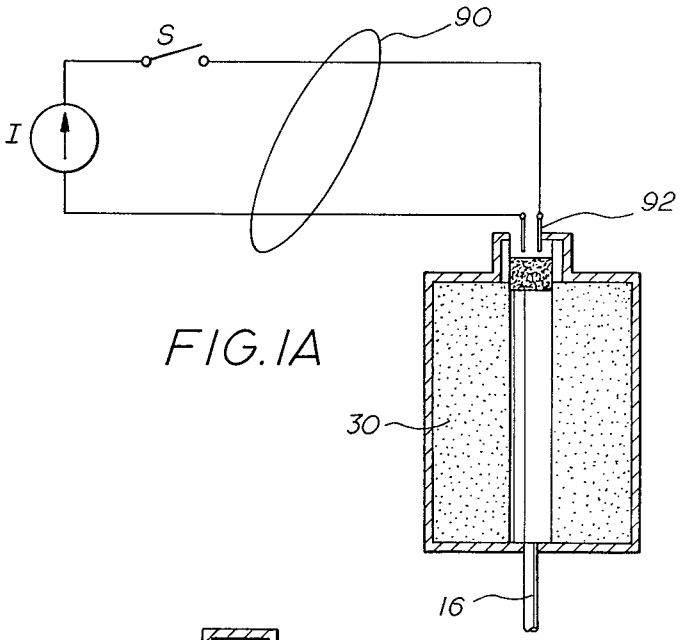
FIGS. 1A and 1B illustrate alternative means for actuating the solid propellant gas generator according to the invention.
Figure 1B:
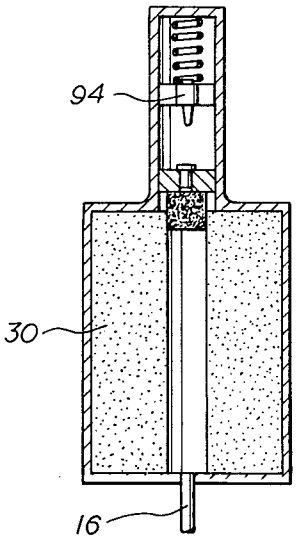
Figure 1:
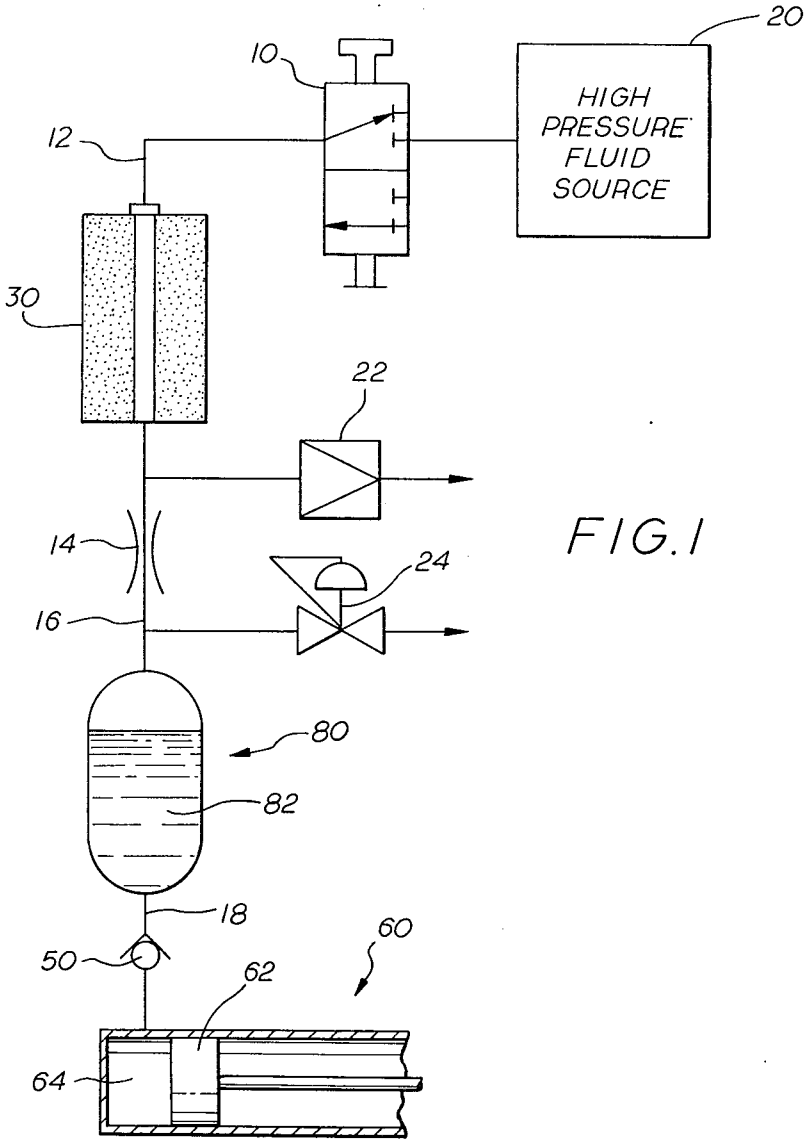
FIG. 1 illustrates schematically the system for generating pressurized hydraulic fluid to operate an oilfield closing device wherein a tank of hydraulic fluid is provided to receive the pressurized gas from a solid propellant gas generator.

FIG. 1 shows a preferred embodiment of the invention in which a solid propellant gas generator 30 is provided with a pressure vessel 80 to apply pressurized hydraulic fluid to the closing chamber 64 of an oilfield closing device 60. The oilfield closing device 60 may be an annular blowout preventer, a ram blowout preventer, a diverter or a similar device which has a hydraulically driven piston 62. The solid propellant gas generator 30 in the embodiment illustrated in FIG. 1 is actuated by means of a pulse of high pressure fluid source 20 applied via actuating conduit 12 via an emergency switch or valve 10. The actuation of the solid propellant gas generator 30 causes high pressure gas to exit via conduit 16 and to be applied to the top of the high pressure fluid tank or vessel 80. The application of high pressure gas causes the hydraulic fluid 82 to be pressurized and applied via conduit 18 to the oilfield closing device 60. A check valve 50 is advantageously provided in the conduit 18 to prevent reverse flow in line 18. A relief valve 24 is connected to conduit 16 to relieve overpressure to high pressure fluid tank 80 from the gas generator 30. A rupture disk 22 is also applied to the conduit 16 to protect the system from maximum excess pressures generated by the gas generator 30. A combustion control orifice 14 is provided between the breech of the solid propellant gas generator 30 and the high pressure fluid tank 80 to control the propellant combustion pressure.

FIG. 1A illustrates an alternative means for actuating the solid propellant gas generator 30. A current source I in circuit or conductor pair 90 with switch S is connected to a detonating squib 92 which serves to actuate the gas generator 30.

FIG. 1B illustrates a mechanical plunger 94 adapted to mechanically actuate the detonator associated with the solid propellant gas generator 30.

Figure 2:
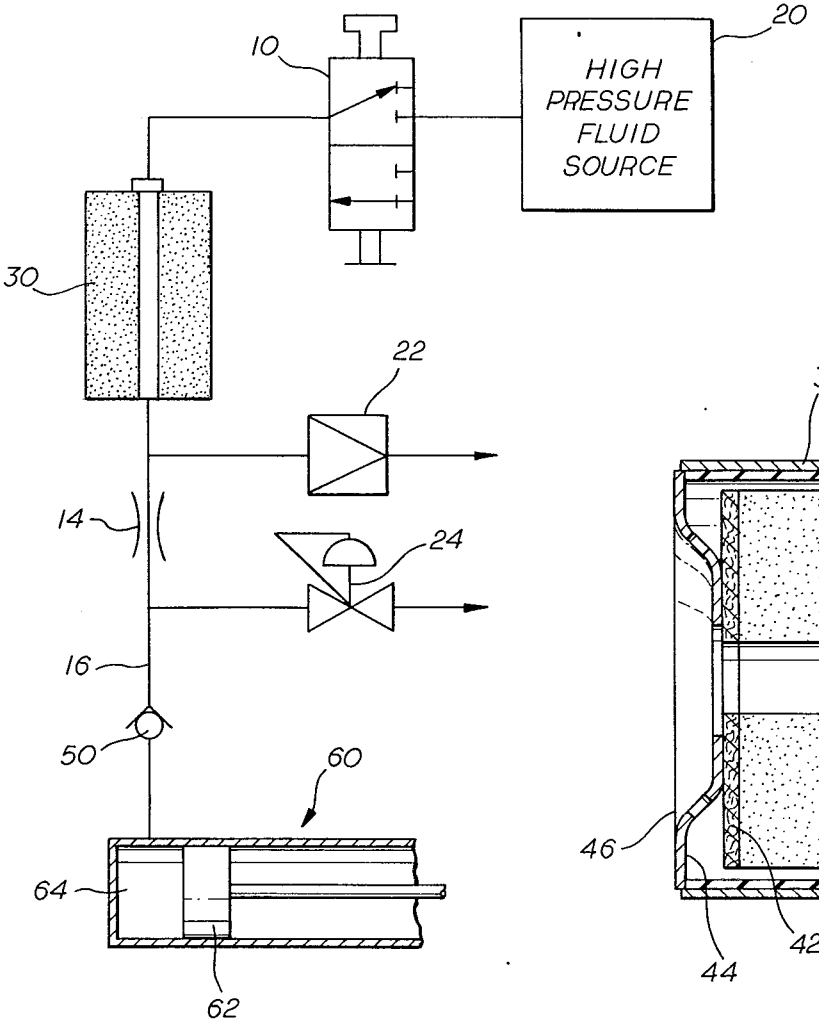
FIG. 2 shows an alternative embodiment of the invention where gas from the solid propellant gas generator is applied directly to the closing chamber of an oilfield closing device.

Turning now to FIG. 2, an alternative embodiment of the invention is provided in which the output of the solid propellant gas generator 30 is applied directly to the closing chamber 64 of the oilfield closing device 60. The embodiment of FIG. 2 is identical in construction to that illustrated in FIG. 1 with the exception that the oilfield closing device 60 is operated by means of pressurized gas directly rather than using pressurized hydraulic liquid. Thus, conduit 16 is connected directly between the output of the gas generator 30 and the closing chamber 64 of the oilfield closing device 60. The high pressure fluid source 20 and the emergency valve 10 of FIG. 1 is identical to that of the embodiment of the invention illustrated in FIG. 2.

Figure 3:
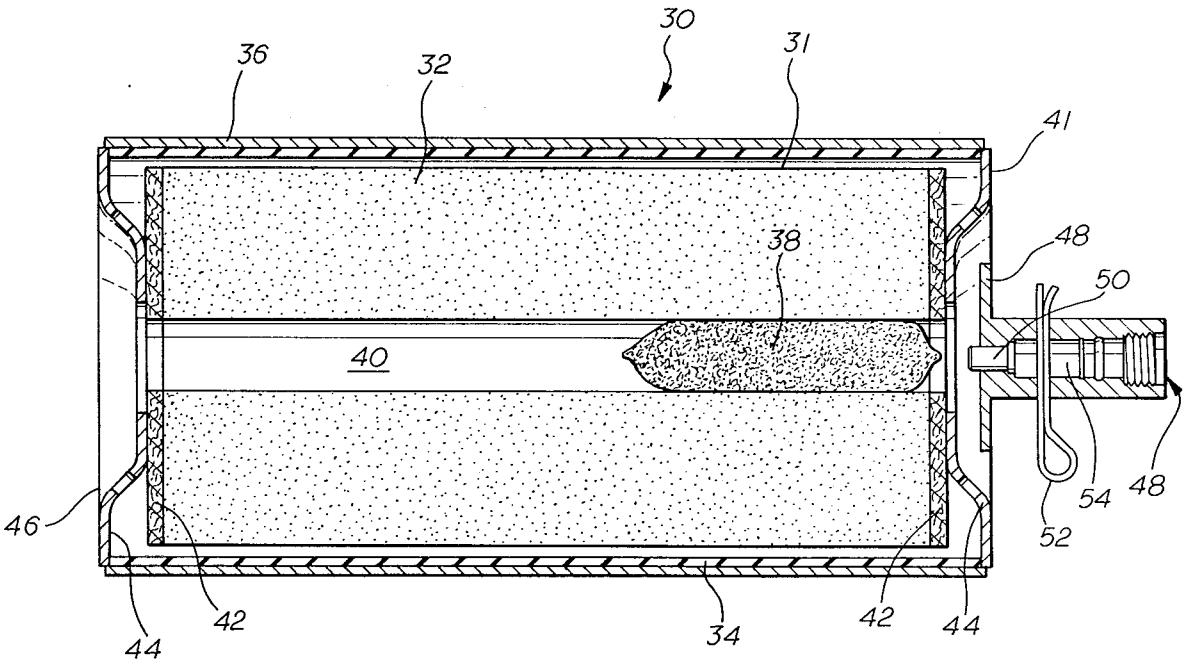
FIG. 3 illustrates a propellant cartridge disposed in a structural breech and a detonator by which the cartridge is actuated.

FIG. 3 illustrates an exemplary configuration of a solid propellant gas generator 30 used in both embodiments of this invention. A solid propellant cartridge 31 is disposed within a structural breech 34 which is in turn is surrounded by a 1/16 inch thick rubber sleeve 36. One eighth inch thick HTPB end inhibitors 42 are provided at each end of the cartridge 31. Preferably, the propellant material 32 of the cartridge comprises a pyrotechnic compound such as RRC4115 commercially available from the Rocket Research Corporation. A polybag ignition booster package 38 is provided in the interior 40 of the cartridge, which when actuated, causes the propellant material to generate high pressure gases.

The structural steel breech 34 is closed at either end by perforated mild steel grain standoff plates 44 having holes provided at their centers. An illuminized mylar tape 46 seals the hole in the output end of the cartridge.

An initiator housing 48 fabricated of mild steel is welded to the end 41 of the structural breech 34. A port 50 for a hydraulic start signal is provided in the end of the initiator housing 48. A removable safety pin 52 protects the cartridge from accidental actuation. When pin 52 is removed, an O-ring seal piston 54 is provided for a detonating device when actuated by a hydraulic signal. Other detonating means may be provided for electrical or mechanical actuation of the cartridge as schematically illustrated in FIGS. 1A and 1B.

There is provided a solid propellant gas generator for use in the system according to the invention which is designed for easy cartridge insertion into a structural breech and convenient spent cartridge removal.

Various modifications and alterations in the described structures will be apparent to those skilled in the art of the foregoing description which does not depart from the spirit of the invention. For this reason, these changes are desired to be included in the appended claims. The appended claims recite the only limitation to the present invention and the descriptive manner which is employed for setting forth the embodiments and is to be interpreted as illustrative and not limitative.

What is claimed is:

1. A system for generating pressurized hydraulic fluid to operate an oilfield apparatus comprising:
   - an oilfield closing device means for closing the oilfield apparatus,
   - a solid propellant gas generator means for generating high pressure gas when actuated,
   - a pressure vessel containing hydraulic fluid,
   - a first conduit connected between the output of said gas generator means and the pressure vessel,
   - a second conduit having a check valve therein connected between said pressure vessel and a closing port of a hydraulically driven piston of said oilfield closing device, and
   - actuating means for actuating said gas generator means, operably causing said high pressure gas to be conducted via said first conduit to force hydraulic fluid in said pressure vessel under pressure via said second conduit to said closing port, said check valve in said second conduit operably preventing fluid pressure in the closing port of said oilfield closing device from feeding back to said pressure vessel.

2. The system of claim 1 further comprising a relief valve connected to said first conduit.

3. The system of claim 1 wherein said solid propellant gas generator means comprises
a structural breech,
a solid propellant gas generator cartridge removably disposed in said structural breech, and
a detonator.

4. The system of claim 3 wherein said actuating means comprises
a pressurized fluid source means,
an actuating conduit disposed between said fluid source means and said detonator, and
a valve disposed in said actuating conduit to allow emergency communication of said fluid source means and said detonator operably actuating said gas generator cartridge.

5. The system of claim 4 wherein said fluid is hydraulic liquid.

6. The system of claim 4 wherein said fluid is gas.

7. The system of claim 3 wherein said actuating means comprises,
a source of electrical current,
a conductor path disposed between said current source and said detonator, and
a switch disposed in said conductor path to allow emergency communication of said electrical current to said detonator operably actuating said gas generator cartridge.

8. The system of claim 3 wherein said actuating means comprises
a mechanical means for manually forcefully impacting said detonator operably actuating said gas generator cartridge.

9. The system of claim 3 further comprising an orifice disposed in the first conduit, said orifice operably controlling the propellant combustion pressure.

10. A system for operating an oilfield closing device comprising
a solid propellant gas generator means for generating high pressure gas when actuated,
a conduit having a check valve therein connected between the output of said gas generator means and a closing port of a gas driven piston of the oilfield closing device, and
actuating means for activating said gas generator means, operably causing said high pressure gas to be conducted via said conduit to said closing port, said check valve in said second conduit operably preventing fluid pressure in said closing port of said oilfield closing device from feeding back to said pressure vessel.

11. The system of claim 10 further comprising a relief valve connected to said first conduit.

12. The system of claim 10 wherein said solid propellant gas generator means comprises
a structural breech,
a solid propellant gas generator cartridge removably disposed in said structural breech, and
a detonator.

13. The system of claim 12 wherein said actuating means comprises
a pressurized fluid source means,
an actuating conduit disposed between said fluid source means and said detonator, and
a valve disposed in said actuating conduit to allow emergency communication of said fluid source means and said detonator operably actuating said gas generator cartridge.

14. The system of claim 13 wherein said fluid is hydraulic liquid.

15. The system of claim 13 wherein said fluid is gas.

16. The system of claim 12 wherein said actuating means comprises,
a source of electrical current,
a conductor path disposed between said current source and said detonator, and
a switch disposed in said conductor path to allow emergency communication of said electrical current to said detonator operably actuating said gas generator cartridge.

17. The system of claim 12 wherein said actuating means comprises
a mechanical means for manually forcefully impacting said detonator operably actuating said gas generator cartridge.

18. The system of claim 12 further comprising an orifice disposed in the first conduit, said orifice operably controlling the propellant combustion pressure.

19. A system for emergency operation of an oilfield apparatus comprising
an oilfield closing device means for closing the oilfield apparatus,
a solid propellant gas generator means for generating high pressure gas when actuated, including
a structural breech,
a solid propellant gas generator cartridge removably disposed in said structural breech, and
a detonator,
a conduit having a check valve therein connected between the output of said gas generator means and a closing port of a fluid driven piston of said oilfield closing device,
actuating means for activating said gas generator means, operably causing said high pressure gas to be conducted via said conduit to said closing port, said check valve in said second conduit operably preventing fluid pressure in said closing port of said oilfield closing device from feeding back to said pressure vessel, said actuating means including
a pressurized fluid source means,
an actuating conduit disposed between said fluid source means and said detonator, and
a valve disposed in said actuating conduit to allow emergency communication of said fluid source means and said detonator operably actuating said gas generator cartridge.

* * * * *